United States Patent [19]

Paquet

[11] Patent Number: 4,617,878

[45] Date of Patent: Oct. 21, 1986

[54] PROCESS AND DEVICE FOR RECOVERY OF THERMAL ENERGY IN A STEAM GENERATING SYSTEM

[75] Inventor: André J. Paquet, Brussels, Belgium

[73] Assignee: Engetra S.A., Fribourg, Switzerland

[21] Appl. No.: 757,623

[22] Filed: Jul. 22, 1985

[30] Foreign Application Priority Data

Jan. 16, 1985 [EP] European Pat. Off. ..... 85870007.3

[51] Int. Cl.[4] ..... F22D 1/40

[52] U.S. Cl. ..... 122/422; 60/678; 60/681; 60/691; 122/7 R; 122/420; 122/421

[58] Field of Search ..... 122/1 A, 7 R, 20 B, 122/420, 421, 422, 485; 110/234; 60/678, 681, 689, 691

[56] References Cited

U.S. PATENT DOCUMENTS

| | | | |
|---|---|---|---|
| 1,152,421 | 9/1915 | Killman | 122/422 X |
| 1,589,646 | 6/1926 | Hicks . | |
| 2,392,325 | 1/1946 | Kuhner | 122/421 X |
| 4,408,460 | 10/1983 | Paquet | 60/678 |
| 4,445,461 | 5/1984 | Farnia | 122/420 X |
| 4,489,679 | 12/1984 | Holt | 122/421 X |
| 4,501,233 | 2/1985 | Kusaka | 122/420 X |
| 4,526,112 | 7/1985 | Warner | 110/234 X |

FOREIGN PATENT DOCUMENTS

| | | |
|---|---|---|
| 541802 | 4/1956 | Belgium . |
| 1122081 | 1/1962 | Fed. Rep. of Germany . |
| 2453488 | 11/1981 | Fed. Rep. of Germany . |
| 1461570 | 12/1966 | France . |
| 1435041 | 12/1966 | France . |
| 1504666 | 12/1967 | France . |
| 2043956 | 2/1971 | France . |
| 2534150 | 4/1984 | France . |

*Primary Examiner*—Albert J. Makay
*Assistant Examiner*—Steven E. Warner
*Attorney, Agent, or Firm*—Walter H. Schneider

[57] ABSTRACT

In a steam generating system, steam condensate extracted from steam used to reheat boiler water in heaters (H1, . . . , H4) is revaporized in the recuperators-vaporizers (RV1, . . . , RV3) by heat exchange contact with the flue gas from boiler (B). The steam thus formed is recycled to contribute to the reheating of the water fed to the boiler.

18 Claims, 9 Drawing Figures

FIG. 2
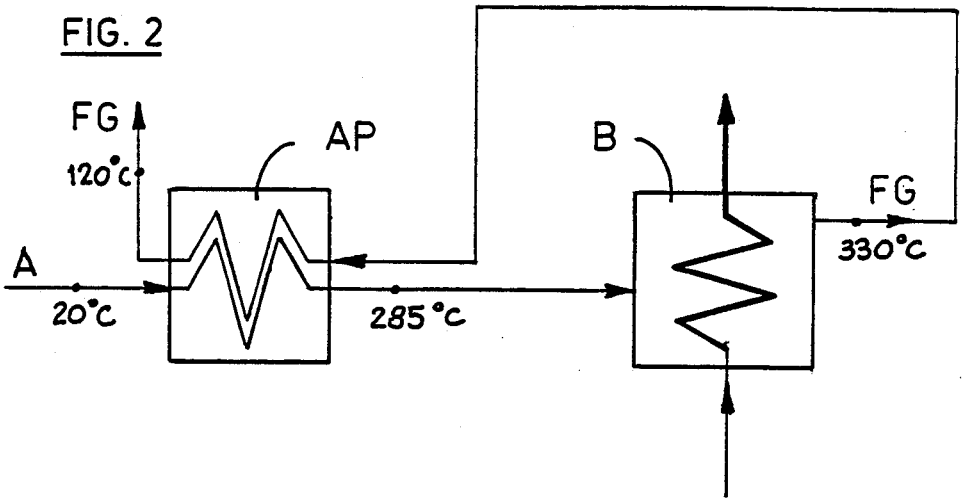
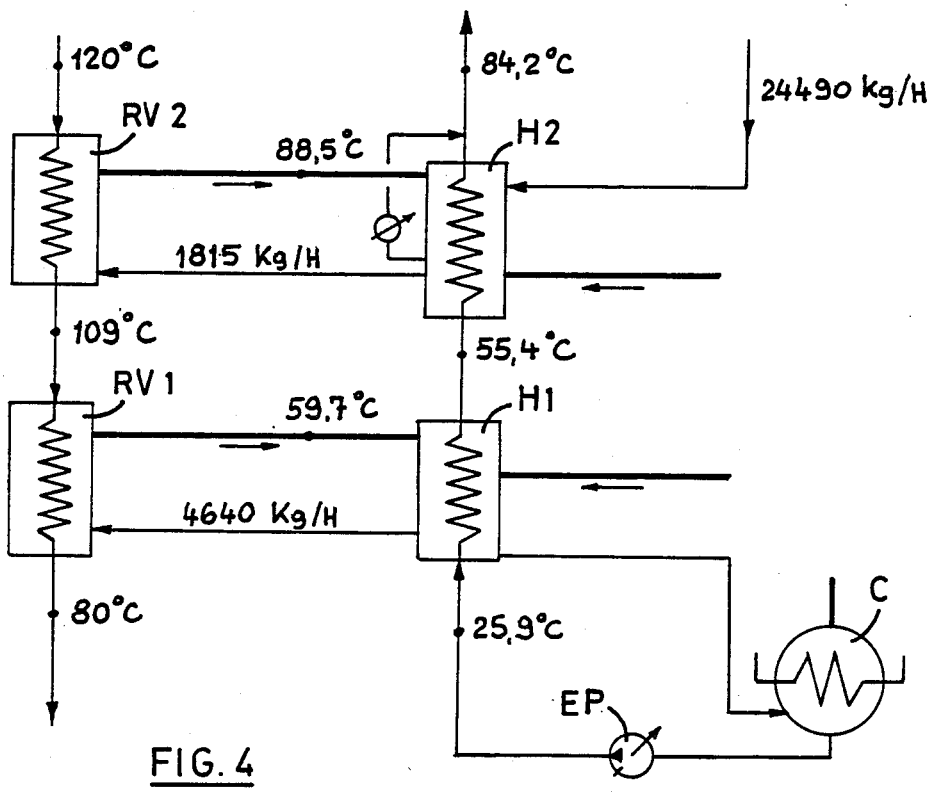
FIG. 4

FIG. 5
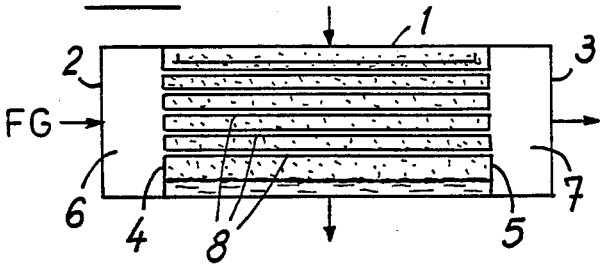
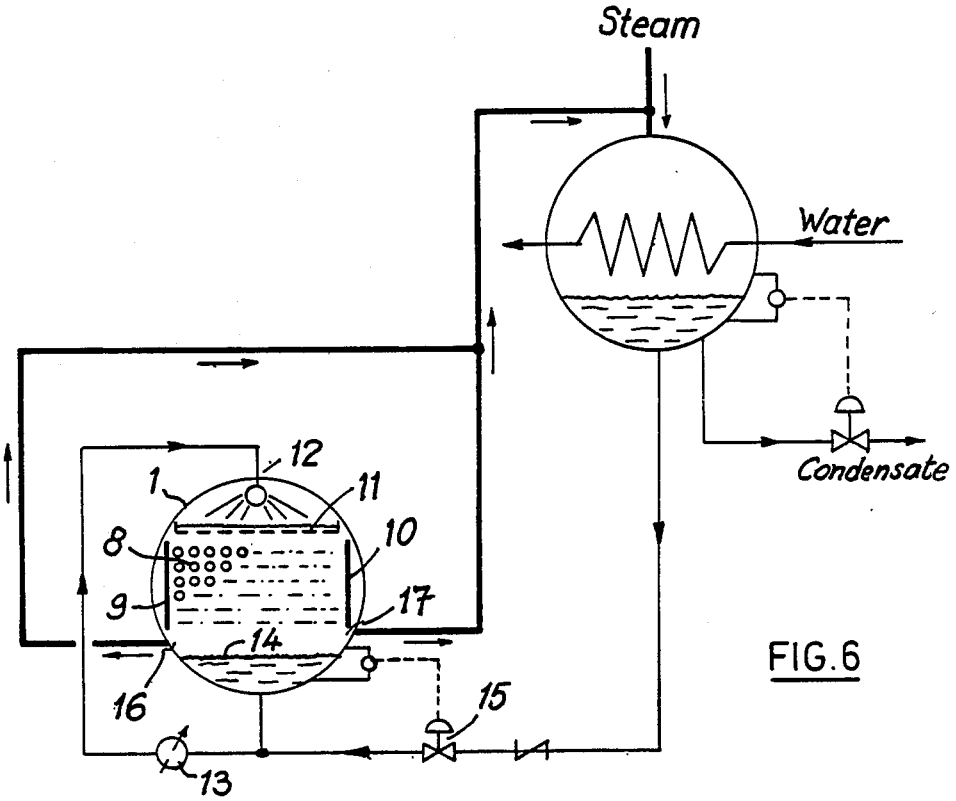
FIG. 6

PROCESS AND DEVICE FOR RECOVERY OF THERMAL ENERGY IN A STEAM GENERATING SYSTEM

BACKGROUND OF THE INVENTION

1. Field of the Invention

This invention concerns a process of recovery of thermal energy of flue gas, more particularly in thermal power stations.

The invention also covers the device for the installation of the process and in particular a new industrial apparatus termed below "recuperator-vaporizer" for short, for the recovery of thermal energy, also termed sensible heat, of the gas resulting from the combustion of fossile fuels (natural gas, coal, lignite, . . . ) of thermal power stations, "flue gas" for short, by its transfer to heater condensates which condensates are vaporized.

By thermal power station, is intended any installation for transformation of thermal energy into mechanical energy by means of condensable fluid making a thermodynamic cycle, in particular fossil fuel thermal power stations.

2. Description of the Prior Art

The known state of the prior technique or art is represented in FIGS. 1 and 2 of the drawing.

FIG. 1 represents the diagram of a conventional thermodynamic cycle of a power station, with the turbine driving an electrical generator not shown. The water cycle comprises passing water to boiler (B) where it is successively heated to the boil, vaporized and superheated. It subsequently expands in the "high pressure" turbine (HPT) and next it is resuperheated (RS). It then expands in the "low pressure" turbine (LPT), after which it condenses in condenser (C), whence water extraction pump (EP) of the condenser conveys it in the successive "low pressure" heaters (H1, H2, H3 and H4) where it is heated by the steam extracted from the turbine (LPT).

The water then reaches the degasser (DG), next the feed tank (FT), at the outlet of which the feed pump (FP) brings it to the high pressure of the cycle and redelivers it to the boiler after passing in the three "high pressure" successive heaters (H6, H7 and H8).

The part of the cycle which is covered by the present invention is essentially the "low pressure" heaters. Patent No. EP 0 032 641 represents in its FIGS. 1 and 3 such a part of the cycle.

The invention also concerns the flues gas cycle represented by FIG. 2. Atmospheric air (A), for example at 20° C., enters the air preheater (AP) where it is preheated, for example to 285° C., by the flue gas. It then enters in the boiler (B) where it burns the fuel and leaves in the form of flue gas (FG), for example at 330° C., to enter the air preheater. This flue gas is cooled by the atmospheric air (A) which it heats and then is discharged to the atmosphere.

Corresponding with the preceding temperatures given as an example, the temperature of the discharged flue gas is 120° C. In practice, the temperature of the flue gas discharged to the atmosphere is between 115° C. and 185° C. An appreciable quantity of energy is thus lost, corresponding to the sensible heat of the flue gas.

The temperature of the flue gas at the outlet of the preheater is conditioned by several factors. As the air preheater is a gas/gas exchanger, it has poorer exchange coefficients than those where a fluid is liquid or those where a fluid changes state. Taking into account the large variations of air temperature going through the exchanger, of the order of 150 to 250 degrees Celsius, the air preheater is a large apparatus of a prohibitive cost if it had still to modify (respectively raise and lower) much more the temperature of the air flows to substantially reduce the energy loss.

However, it is the taking into consideration of the water condensation phenomenon, as the water may be acidified by the oxides of sulphur resulting from the combustion of sulphureous fuels, in the flue gas which will determine the minimum permissible temperature for the flue gas. This condensation is fundamentally avoided because of the dangers of corrosion and of the cost of the preheater if it had to be made in special materials resistant to sulphuric acid. In air preheaters, the condensation phenomenon on cold walls is stimulated by the low temperature of the ambient air entering therein, the temperature of which is markedly below the dew point of the flue gas. The dew point is a function of the humidity of the flue gas, which depends on the hydrogen content of the fuel. In many cases it is between 60° and 70° C. The presence of sulphur oxides however raises this dew point. Taking into account this condensation phenomenon on cold walls, the average temperature of the outgoing flue gas must be markedly above the theoretical dew point.

Another element to be taken into consideration is the draught of the stack discharging the flue gas to the atmosphere. A high temperature is favorable to the draught of the stack (reduction of the air blowing power) and to the dispersion of the flue gas in the atmosphere.

On the other hand, constraints concerning the protection of the environment currently lead to desulphurize (partly) the flue gas, essentially to reduce the acidity of rain.

The standard processes of desulphurization consist in scrubbing the flue gas with chemical solutions. It is desirable for this operation that the flue gas should not enter at an excessively high temperature (particularly at the air heater outlets) in the desulphurization installation. Patent No. FR 2 534 150 describes a desulphurization installation of flue gas where this gas is cooled beforehand to about 80° C. in a heat exchanger which, after desulphurization, reheats it to convey it to the stack. But the heating of the desulphurized flue gas is not absolutely necessary since the stack and its blower can be dimensioned for fairly cool gases. It is also possible to discharge this flue gas through natural draught cooling towers, which can disperse the flue gas in the atmosphere much more advantageously with respect to the protection of environment than the conventional stacks of power stations. Patent DE 24 53 488 concerns the discharge of cleaned flue gas by the natural draught cooling towers.

SUMMARY OF THE INVENTION

The present invention aims to recover the sensible energy of flue gas.

More particularly, this invention aims to recover the sensible energy of flue gas, between 115° and 185° C., between its leaving the air preheater and the precipitator and its entering the desulphurization installation or its discharge to the stack. However, it is not limited to this single special application.

It is also an object of this invention to mitigate the drawbacks of prior art installations by limiting the temperature of the flue gas at the outlet of the air preheaters and to prevent condensation phenomenon on cold walls and the necessity of large exchange surfaces which gas/gas exchangers require.

These objectives are attained by the invention as defined in the claims made at the end of this description.

DESCRIPTION OF THE DRAWINGS

In the drawings which illustrate that which is presently regarded as the best mode for carrying out the invention, FIG. 2 is a diagram of the flue gas circuit in a conventional thermodynamic cycle of a power station as in FIG. 1, FIGS. 5 and 6 show sectional representations of a recuperator-vaporizer.

DESCRIPTION OF THE PREFERRED EMBODIMENTS

Figure 1:
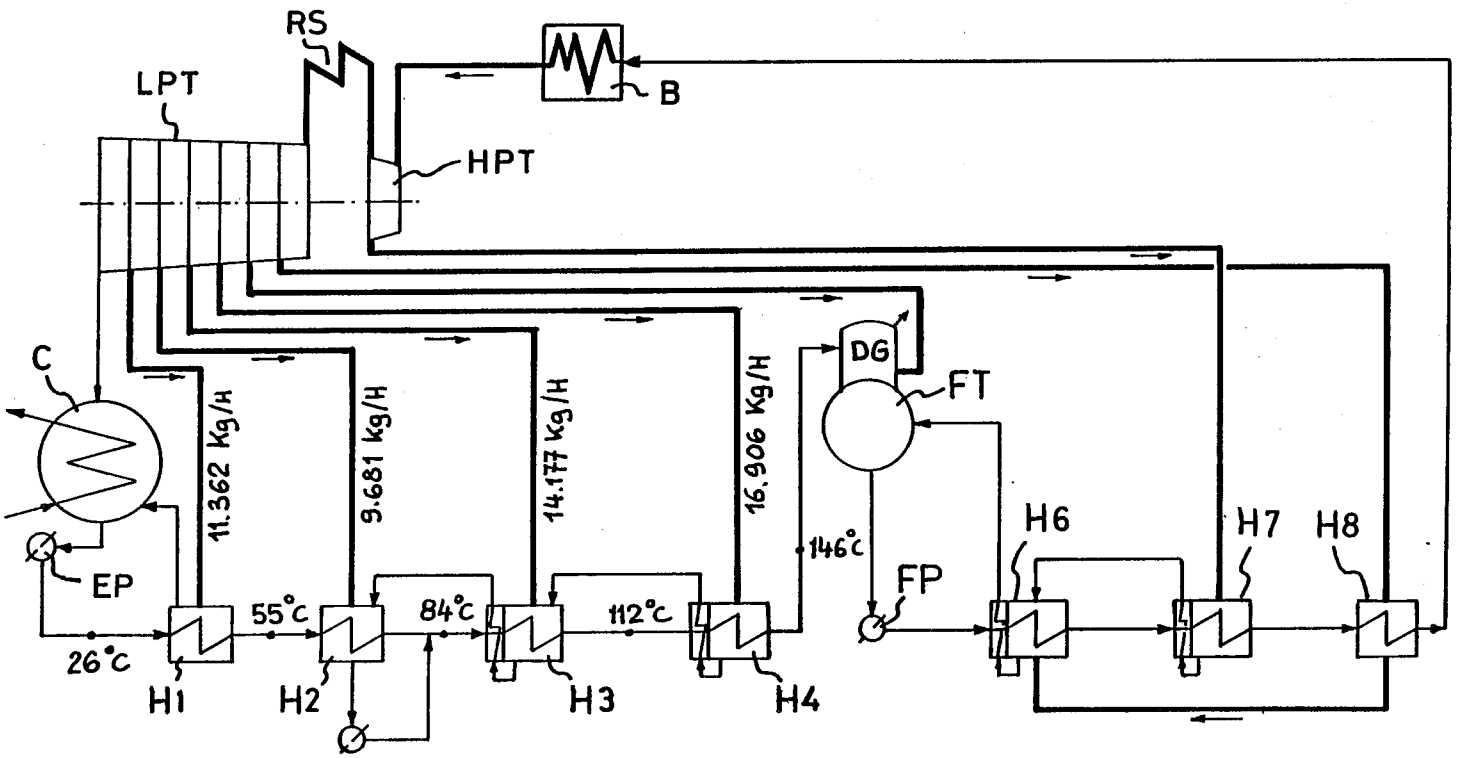
FIG. 1 is a diagram of a conventional thermodynamic cycle of a power station without the electrical generator.
Figure 3:
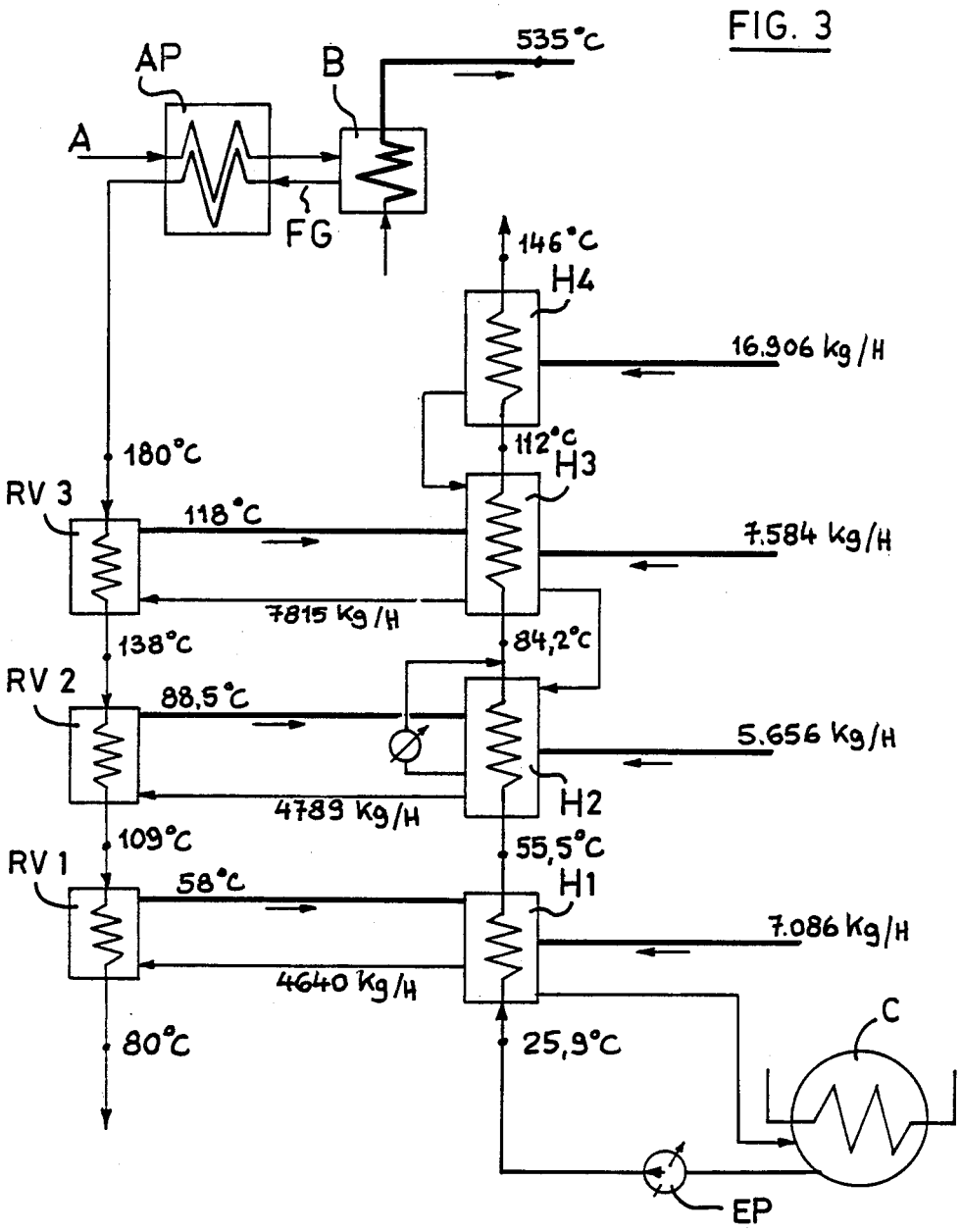
FIG. 3 is a diagram of the low pressure heaters of a cycle as in FIG. 1 in which the recuperator-vaporizers in accordance with this invention have been incorporated, FIG. 4 corresponds to FIG. 3 in which only two recuperator-vaporizers are used.

FIG. 3 represents the part of the cycle of FIG. 1 comprising the "low pressure" heaters (H1 to H4) where recuperators-vaporizers have been incorporated, in this case three apparata: RV1, RV2 and RV3. These recuperators-vaporizers are steel cylinders containing a nest of tubes. The flue gas is conveyed inside the tubes and passes successively in RV3, RV2 and RV1 as it cools.

The RVs receive also a fraction of the condensates of heaters (H1, H2, H3) which vaporize them on contact with the tubes of the RVs conveying the flue gas. The steam formed is set back to the heaters whence the condensates came.

In the example represented in FIG. 3, RV3 is associated with H3, RV2 with H2 and RV1 with H1, and the flue gas comes from the air preheater (AP) at 180° C.

The recuperators-vaporizers, therefore, transfer the thermal energy to the heaters essentially in the form of latent heat of vaporization; this contribution of energy by the flue gas entails a reduction of the extraction of steam at the turbine for the heater associated with the recuperator-vaporizer.

A greater flow of steam is then available at the turbine to expand in it by converting its internal working energy into mechanical work. Quantities of steam extracted for heaters H1, H2 and H3 given in FIG. 3 are effectively substantially smaller than those given in FIG. 1.

The efficiency of the thermodynamic cycle is accordingly improved by 1 to 1.5%.

If the gas at the air preheater outlet is at only 120° C., it will only be possible to place in the cycle of FIG. 1 two recuperators-vaporizers, as shown in FIG. 4.

The condensation temperatures in the heaters and the temperature of the flue gas determine the selection of the number of heater which can be associated with recuperators-vaporizers.

Preferably, the injection of residual energy of the flue gas in the water of the cycle will be made in stages, one for each heater. The energy injection is made at a temperature level slightly lower than that of the flue gas, the hottest flue gas being associated with the hottest condensate, the coldest flue gas with the coldest condensate.

In the succession of heaters considered from the condenser to the boiler, there is a heater from which an association with a recuperator-vaporizer is no longer possible because the temperature of its condensate is close to or above that of the flue gas, making it impossible for the transfer of thermal energy of the flue gas to the heater.

In the succession of heaters, it is possible for one heater not to be associated with a recuperator-vaporizer, whilst the preceding heater and the following heater are. This will fundamentally be the case when the heat exchange envisaged in this heater to too small for the capitalized gain of energy due to the improvement of the thermodynamic efficiency of the cycle to offset the investment costs of a recuperator-vaporizer.

Finally, it is possible that the first or the first few heaters from the condenser will not be coupled to a recuperator-vaporizer, because the heat exchange would be too low, as cited above. Since the thermodynamic gain is smaller as the temperature and the pressure become lower, the economic benefit concerning the installation of a recuperator-vaporizer diminishes as the condenser is approached, and can no longer justify this installation of a recuperator-vaporizer.

On the other hand, the temperature lowering of the flue gas below the acid dew point could lead to the use of more costly materials, entailing investment costs which would no longer be offset by the reduction in generating costs due to the improvement of the cycle efficiency by a recuperator-vaporizer where the temperature of the flue gas would drop to below the dew point.

The invention also applies to cases where all the heaters are at the same pressure on the water side, except for head losses. In these cases, there is only one pump EP located at the condenser outlet and there is no difference between "low pressure" and "high pressure" heaters.

FIGS. 5 and 6 represent in section, repectively, parallel to the length and perpendicular to the length, a recuperator-vaporizer.

This apparatus consists of a vessel 1 having ends 2 and 3. These ends, together with the tube plates 4 and 5, form the "smoke boxes" 6 and 7. The flue gas (FG) enters the recuperator vaporizer at 6 and leaves it at 7.

The tube plates 4 and 5 are joined by "smoke tubes" 8, allowing the sealed passing of the flue gas therethrough from smoke box 6 to smoke box 7. Tube diameter is generally between 25 and 100 mm, for example 38 mm.

The tubes are grouped in superimposed layers, for example twenty-five layers of thirty-five tubes, being inscribed, in accordance with the section of FIG. 6, in a rectangle.

The parallelepiped-shaped nest of tubes 8 is enclosed laterally by partitions 9 and 10. It is surmounted by a distribution tray 11 the bottom of which is perforated by a large number of holes permitting tubes 8 to be sprayed with water, i.e. a fraction of the condensate of a heater, which enters through orifice 12.

On contact of tubes 8 carrying the flue gas (FG) the water sprayed over tubes 8 is partially vaporized. The steam formed escapes through orifices 16 and 17 located above water level 14 which can be adjusted by valve 15.

So as to provide an adequate spraying flow, a pump 13 draws the condensate at the bottom of the recuperator-vaporizer and recycles it as shown.

The materials forming the elements in contact with the water (condensate and steam), i.e. vessel 1, partitions 9 and 10, tray 11, inside structural elements (supports spacers, etc.) are similar to those used for the heaters, for example, steel.

Tubes 8 and tube plates 4 and 5 must be able to withstand the flue gas. They may be constructed of the same material as the partitions, but if the flue gas is particularly corrosive, it may be necessary to construct them of an even higher grade material such as stainless steel or nickel-base alloy.

Figure 9:
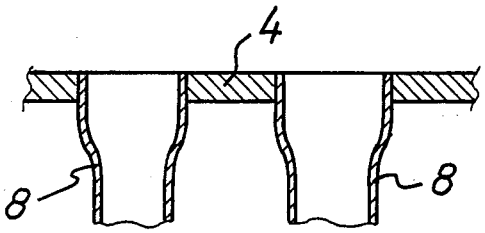
FIG. 9 illustrates a detail of the structural relationship of smoke tubes and a tube plate.

If the gas is very corrosive and displays condensation phenomena of acid solutions, then tubes 8 might be constructed of a ceramic material or of glass or a fluoride organic polymer. The material of tubes 8 and of plates 4 and 5 can also be composite, for example, stainless steel covered by a layer of polytetrafluoroethylene. The smoke box walls can be covered with suitable polymeric resin, to protect them from corrosive action of the flue gas. As shown in FIG. 9, the smoke tubes may be mounted in the tube plate 4 (or 5) by swaging.

When the temperature of the flue gas is lowered to below the dew point, the recuperator-vaporizer has the advantage of partly desulphurizing the flue gas.

Since the outside faces of the tubes are in contact with a fluid, i.e. water presenting an intense phase change, in this case a vaporization in the form of boiling, the corresponding heat transfer coefficients are excellent, better than with a gas and better than with a liquid. This particularity of the thermal exchange clearly reduces the dimensions of the apparatus compared, in particular, to a gas/gas exchanger such as the air preheater.

As for the heat transmission on the inside face of the tubes, it can be increased, for example, by internal fins, increasing the surface of contact and the turbulence of the gas.

It is to be noted that the fluid in indirect contact with the flue gas through the intermediary of the walls is at the fairly high temperatures of the heater condensates which is much higher than that of ambient air. Therefore the condensation phenomenon on the cold walls is reduced, if not avoided.

In the case of FIG. 3, the power gain is of the order of 1.5 MW at the turbine shaft, the latter driving an alternator delivering 125 MW to the electrical network.

In the case of FIG. 4, the gain is 0.35 MW at the turbine shaft.

Such gains are clearly greater than the cost of recuperators-vaporizers capitalized over the life of the power station.

Figure 7:
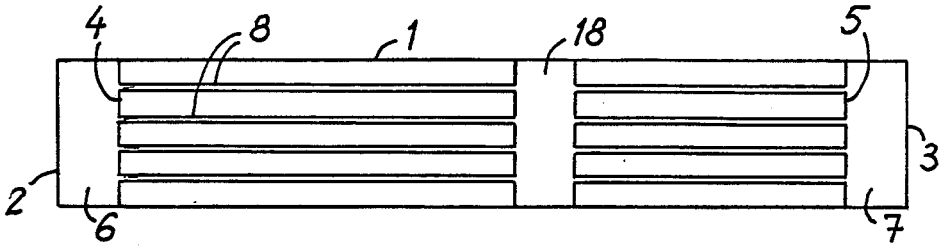
FIGS. 7 and 8 show recuperator-vaporizer representations in which more than one recuperator-vaporizer are integrated into a single unit.

As a variant, two or several successive recuperators-vaporizers can be integrated in a single apparatus, with a smoke box 18 common to two recuperators-vaporizers and located between them. FIG. 7 represents such a variant integrating two recuperators-vaporizers.

Figure 8:
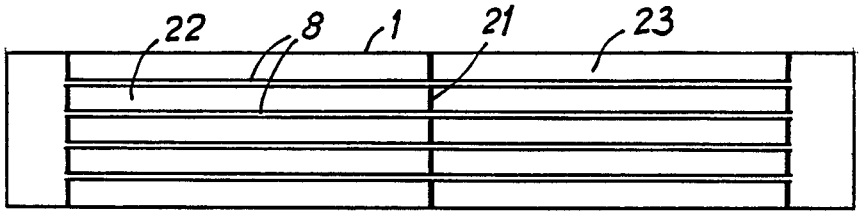

The integration of two successive apparata can even go farther, as represented in FIG. 8, where there is no longer an intermediate smoke box. Tubes 8 of such a double recuperator-vaporizer have a length corresponding to the whole of the two apparata, i.e. a length equal to the sum of the lengths of the tubes of the two recuperators-vaporizers of FIG. 7, all the other things being unchanged. In the double apparatus of FIG. 8, the two recuperators-vaporizers are separated by a sealed tube plate 21 not allowing the passage of fluid between spaces 22 and 23.

Reference in this disclosure to details of the specific embodiments is not intended to restrict the scope of the appended claims which themselves recite those features regarded as essential to the invention.

I claim:

1. In a power generating system comprising (1) a water cycle in which steam expansion condensate from the expansion of steam in a turbine is recovered and heated, prior to recycling to a steam generator, with steam extracted from the steam expansion, and (2) a flue gas cycle in which flue gas from the steam generator is recycled to preheat the air used to support combustion in the steam generator, the process for recovering additional thermal energy from the flue gas cycle which comprises using the flue gas discharged from the preheater to heat the steam expansion condensate in the water cycle and extract heat from the flue gas by passing it in heat exchange with the steam heater condensate resulting from the heating of the steam expansion condensate with expansion steam, the resultant stream being recycled to said heaters to heat said steam expansion condensate.

2. A process according to claim 1 in which the heating of the steam expansion condensate and the extraction of heat from the flue gas are conducted in progressive temperature stages.

3. A process according to claim 2 in which the temperature of the steam heater condensate in any temperature stage is always less than the temperature of the flue gas in said stage, and the steam heater condensate from the hottest heating stage is used with the flue gas in the hottest extraction stage and the steam heater condensate from the coolest heating stage is used with the flue gas in the coolest extraction stage.

4. In a power generating system comprising a steam generator, means for preheating combustion air with flue gas from said steam generator, a turbine for expanding said steam, a plurality of heaters in series for heating steam expansion condensate from said turbine with expanded steam from said turbine, and means for recycling heated steam expansion condensate to said steam generator, the improvement for extracting additional energy from said flue gas which comprises means for using said flue gas to generate steam from the steam heater condensates recovered from said heaters, and means for recycling said steam to said heaters to heat said steam expansion condensate.

5. The improvement according to claim 4 in which said extraction means comprises a plurality of heat exchangers each of which is connected to a heater whereby steam is generated from said steam heater condensate by being passed in heat exchange with said flue gas.

6. The improvement according to claim 5 in which the heat exchangers and heaters are arranged so that the hottest steam heater condensate is passed in heat exchange with the hottest flue gas.

7. The improvement according to claim 5 in which the heat exchanger comprises two smoke boxes connected by a plurality of tubes, means for passing flue gas into one smoke box from which it is discharged, and means for introducing steam heater condensate into said heat exchanger so as to flow over said tubes.

8. The improvement according to claim 7 in which the heat exchanger comprises at least two sets of plurality of tubes positioned end to end with a common smoke box between the tube ends of adjacent sets.

9. The improvement according to claim 7 in which the heat exchanger is divided at approximately its center by a seal tube plate, said tubes passing through said plate.

10. In a power generating system comprising a water cycle in which steam expansion condensate from the expansion of steam in a turbine is recovered and heated, prior to recycling to a steam generator, with steam extracted from the steam expansion, said steam generator producing flue gas, the process for recovering thermal energy from the flue gas, which comprises using said flue gas to heat the steam expansion condensate in the water cycle and extract heat from said flue gas by passing it in heat exchange with the steam heater condensate resulting from the heating of the steam expansion condensate with the expansion steam, the resultant steam being recycled to said heaters to heat said steam expansion condensate.

11. A process according to claim 10 in which the heating of the steam expansion condensate and the extraction of heat from the flue gas are conducted in progressive temperature stages.

12. A process according to claim 11 in which the temperature of the steam heater condensate in any temperature stage is always less than the temperature of the flue gas in said stage, and the steam heater condensate from the hottest heating stage is used with the flue gas in the hottest extraction stage and the steam heater condensate from the coolest heating stage is used with the flue gas in the coolest extraction stage.

13. In a power generating system comprising a steam generator with a flue gas outlet, a turbine for expanding said steam, a plurality of heaters in series for heating steam expansion condensate from said turbine with expanded steam from said turbine, the improvement for extracting energy from said flue gas which comprises means for using said flue gas to generate steam from the steam heater condensate recovered from said heaters, and means for recycling said steam to said heaters to heat said steam expansion condensate.

14. The improvement according to claim 13 in which said extraction means comprises a plurality of heat exchangers each of which is connected to a heater whereby steam is generated from said steam heater condensate by being passed in heat exchange with said flue gas.

15. The improvement according to claim 14 in which the heat exchangers and heaters are arranged so that the hottest steam heater condensate is passed in heat exchange with the hottest flue gas.

16. The improvement according to claim 14 in which the heat exchanger comprises two smoke boxes connected by a plurality of tubes, means for passing flue gas into one smoke box from which it is discharged, and means for introducing steam heater condensate into said heat exchanger so as to flow over said tubes.

17. The improvement according to claim 16 in which the heat exchanger comprises at least two sets of plurality of tubes positioned end to end with a common smoke box between the tube ends of adjacent sets.

18. The improvement according to claim 16 in which the heat exchanger is divided at approximately its center by a seal tube plate, said tubes passing through said plate.

* * * * *